United States Patent [19]

Yoshida

[11] Patent Number: 4,493,425

[45] Date of Patent: Jan. 15, 1985

[54] RACK ASSEMBLY APPARATUS

[76] Inventor: Tsukasa Yoshida, 15-202 Nikko Danchi, 1-3 Nikko-cho, Fuchu-shi Tokyo, Japan

[21] Appl. No.: 493,879

[22] Filed: May 12, 1983

[51] Int. Cl.[3] ..... A47B 47/00

[52] U.S. Cl. ..... 211/189; 211/191; 211/182; 211/186; 312/140; 108/114; 403/171

[58] Field of Search ..... 211/189, 191, 182, 186; 403/170, 171, 176, 173, 310; 312/140, 263, 264; 108/111, 114; 52/234; 46/31

[56] References Cited

U.S. PATENT DOCUMENTS

| | | | |
|---|---|---|---|
| 280,884 | 7/1883 | True | 403/310 X |
| 1,281,856 | 10/1918 | Shaw | 211/189 X |
| 1,784,572 | 12/1930 | Brown | 403/171 |
| 2,715,794 | 8/1955 | Atkinson | 312/140 X |
| 3,069,216 | 12/1962 | Vaeth | 211/186 X |
| 3,890,738 | 6/1975 | Bassani | 46/31 X |
| 3,973,855 | 8/1976 | Florence | 403/171 |
| 4,058,909 | 11/1977 | Poleri | 46/31 X |
| 4,186,533 | 2/1980 | Jenson | 46/31 X |
| 4,323,319 | 4/1982 | Adams | 403/176 X |

FOREIGN PATENT DOCUMENTS

| | | | |
|---|---|---|---|
| 815686 | 7/1959 | United Kingdom | 46/31 |

*Primary Examiner*—Ramon S. Britts
*Assistant Examiner*—Blair M. Johnson
*Attorney, Agent, or Firm*—Sughrue, Mion, Zinn, Macpeak & Seas

[57] ABSTRACT

A rack assembly apparatus assembled by fitting panels and transverse beams to connection members, said apparatus characterized in that panel fitting plates consisting of two parallel panel fitting support plates are formed at the base of each of said connection members so as to project vertically from both surfaces and to define a panel fitting groove between said panel fitting support plates, an engaging protuberance is formed at the bottom of each of said panel fitting grooves, a transverse fitting groove is defined along the outer surface of said panel fitting plate, an engaging protuberance is also formed at the bottom of said transverse beam fitting groove, said panel and said transverse beam are equipped with engaging notches, respectively, said panel is fitted into said panel fitting groove of said connection member while said transverse beam is fitted into said transverse beam fitting groove, said engaging notches of said panel and said transverse beam are engaged with said protuberances of said connection member, respectively and rack plates are placed on said transverse beams.

6 Claims, 11 Drawing Figures

FIG. 1
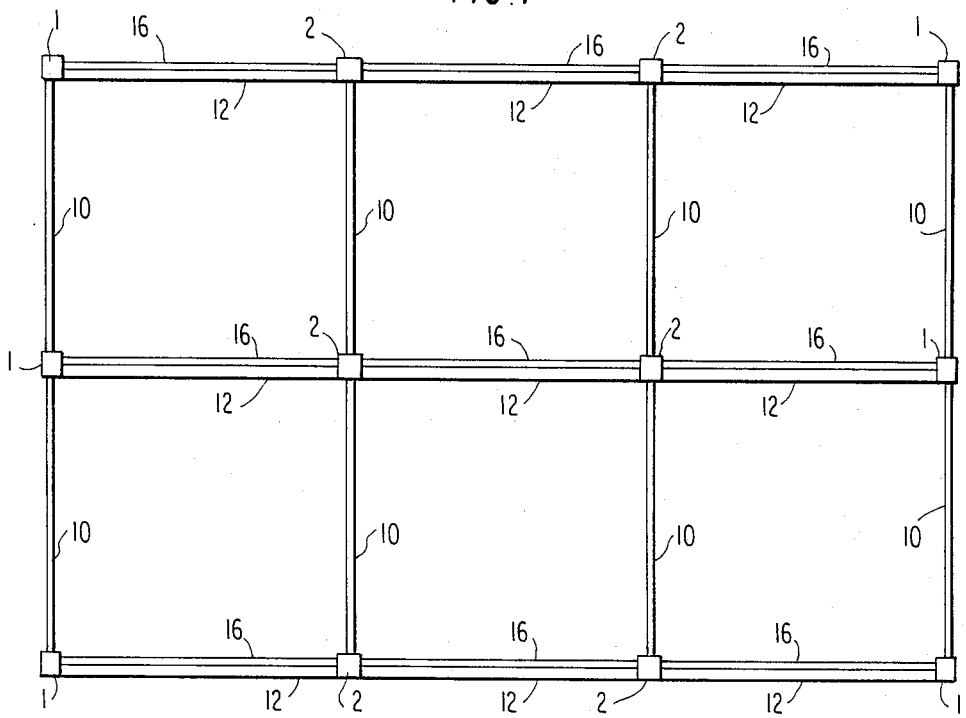
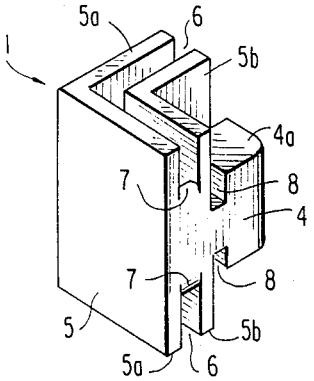
FIG. 2
FIG. 3
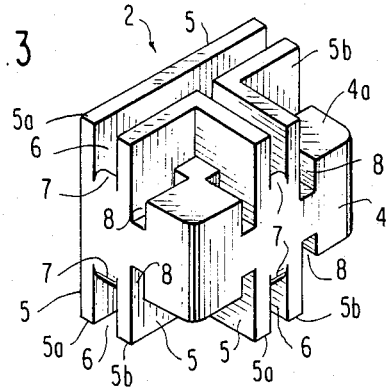
FIG. 4
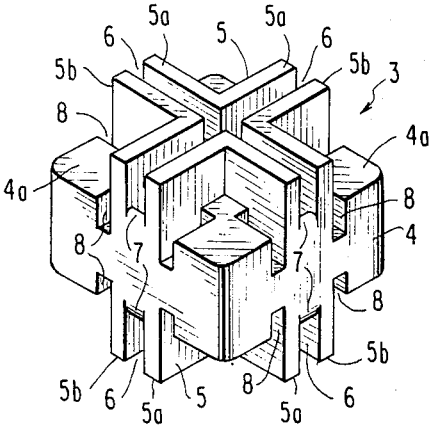
FIG. 5
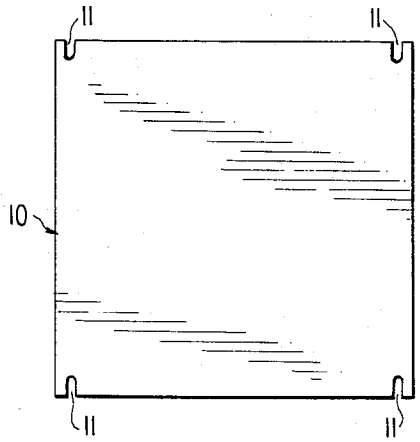

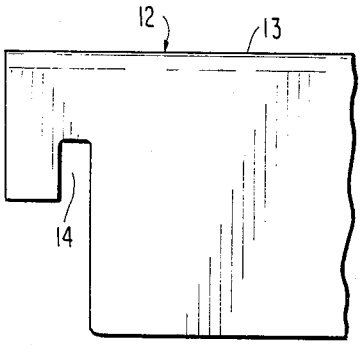
FIG. 6A
FIG. 6B
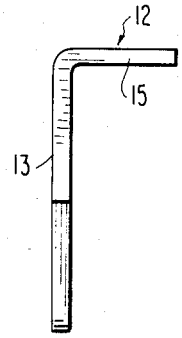
FIG. 7
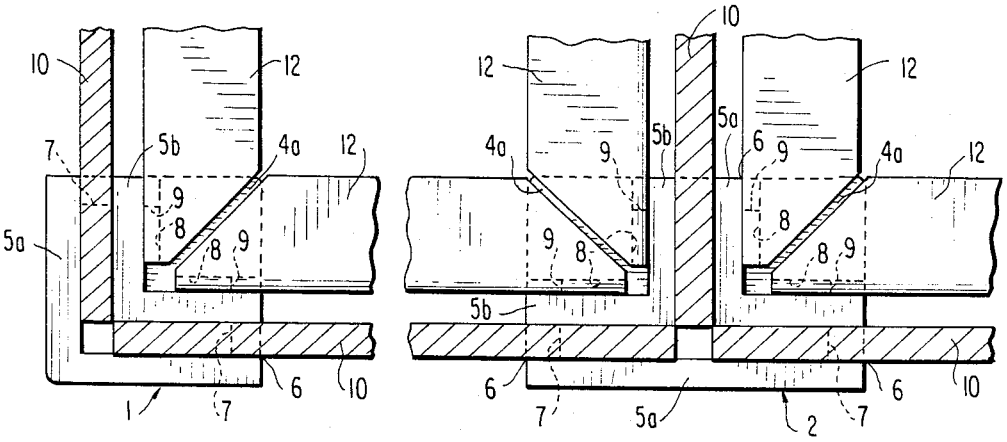
FIG. 8
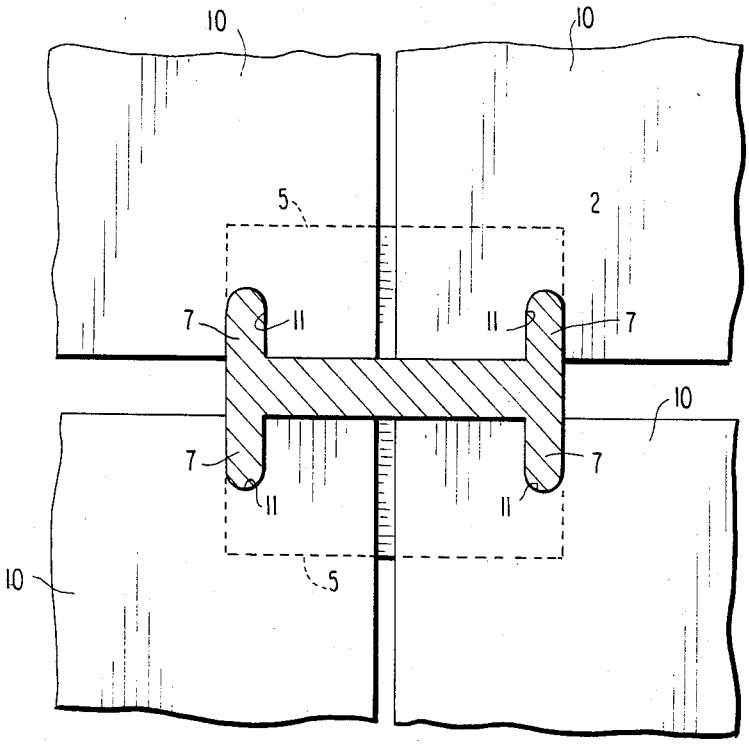

FIG. 9
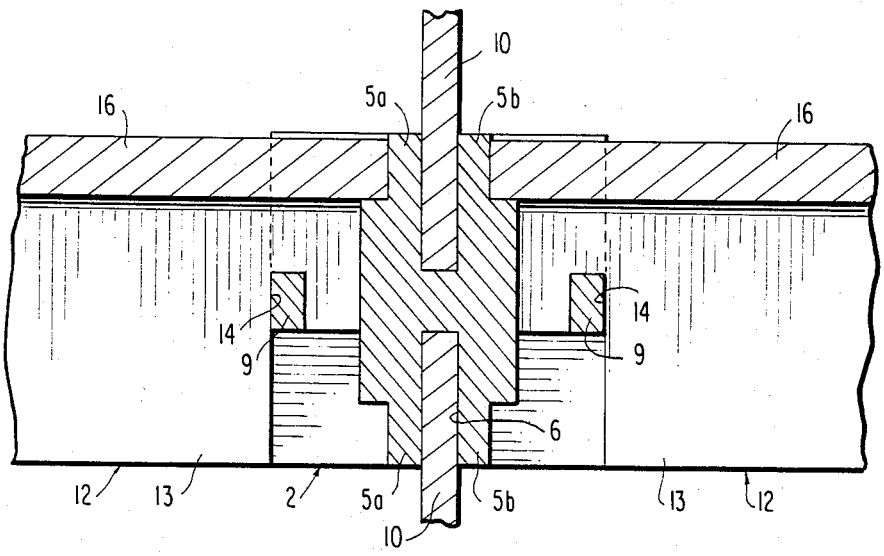
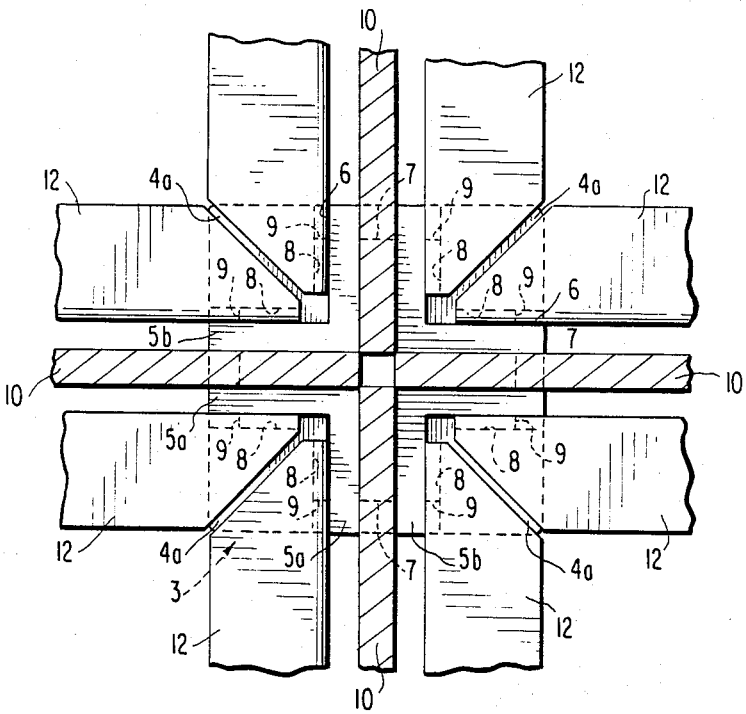
FIG. 10

RACK ASSEMBLY APPARATUS

BACKGROUND OF THE INVENTION

This device relates to a rack assembly apparatus for use in assembling decorative racks, display racks or racks for storing articles.

It has been a customary practice to assemble the rack of the kind described above by fixing rack plates, side plates and the like by use of nails or screws. If the rack is fixed in this manner, however, disassembly of the rack is very troublesome and time-consuming and if the rack is a display rack whose design or pattern must be frequently changed, the rack constituents after disassembly are damaged and can not be used again.

To obviate these problems, various assembly apparatuses for assembly type racks have been developed and various assembly tools and jigs have been developed, but the conventional assembly apparatuses involve the problems that they are complicated in construction, are expensive to produce and easy to break and their assembly is difficult. Since the joints of the constituent members one not sufficiently strong, the rack after assembly undergoes shaking during use for an extended period of time.

SUMMARY OF THE INVENTION

To eliminate these problems, the present device is directed to provide a rack assembly apparatus which is simple in construction, does not call for any particular jigs or tools at the time of assembly but can be assembled easily within a short period of time and yet can firmly join the constituents with one another, and can be easily disassembled rapidly without damaging the constituents.

The present invention is directed to a rack assembly apparatus assembled by fitting panels and transverse beams to connection members, said apparatus characterized in that panel fitting plates consisting of two parallel panel fitting support plates are formed at the base of each of said connection members so as to project vertically from both surfaces and to define a panel fitting groove between said panel fitting support plates, an engaging protuberance is formed at the bottom of each of said panel fitting grooves, a transverse fitting groove is defined along the outer surface of said panel fitting plate, an engaging protuberance is also formed at the bottom of said transverse beam fitting groove, said panel and said transverse beam are equipped with engaging notches, respectively, said panel is fitted into said panel fitting groove of said connection member while said transverse beam is fitted into said transverse beam fitting groove, said engaging notches of said panel and said transverse beam are engaged with said protuberances of said connection member, respectively, and rack plates are placed on said transverse beams.

BRIEF DESCRIPTION OF THE DRAWINGS

The accompanying drawings illustrate the embodiment of the present device, wherein:

FIG. 1 is a front view of the rack.

FIG. 2 is a perspective view of the connection member 1.

FIG. 3 is a perspective view of the connection member 2.

FIG. 4 is a perspective view of the connection member 3.

FIG. 5 is a front view of the panel.

FIG. 6A is a front view of one end of the transverse beam.

FIG. 6B is a side elevation view of the transverse beam of FIG. 6A.

FIG. 7 is a partial transverse sectional plan view showing the state of connection between the connection members 1, 2, and the panels and the transverse beams.

FIG. 8 is a longitudinal sectional view showing the state of connection between the connection members and the panels.

FIG. 9 is a longitudinal sectional view showing the state of connection between the connection members and the transverse beams.

FIG. 10 is a partial transverse sectional plan view showing the state of connection between the connection members 3 and the panels and the transverse beams.

DETAILED DESCRIPTION OF THE DRAWINGS

Hereinafter, the present device will be described with reference to an embodiment thereof shown in the accompanying drawings. The apparatus of the present device is of the type "in which panels, glass sheets or the like are fitted to connection members consisting of a rigid material such as a synthetic resin, a metal or a wood", and comprises three kinds of connection members, i.e., connection members 1 to be used at the corners of the rack, connection members 2 to be used at the intermediate portions of the rack and connection members 3, panels 10, transverse beams 13 and rack plates 16, the members 10, 13 and 16 being to be fitted to the connection members.

As shown in FIGS. 2 and 7, each connection member 1 has a rectangular parallelopipedonal base 4 having a regular square front, and an L-shaped panel fitting plate 5 is formed so as to project along two adjacent side edges of both surfaces of the base 4. Each panel fitting plate 5 consists of two fitting support plates 5*a*, 5*b* arranged in parallel with each other that define an thinly elongated fitting groove 6 between them. This fitting groove 6 is also bent in the L-shaped from. An engaging protuberance 7 is formed at the bottom of each fitting groove 6 so as to project towards the open portion. On the other hand, a thinly elongated, transverse beam fitting groove 8 that opens outward is further defined at the portion of the base 4 extending along the fitting support plate 5*b* that is disposed inward. An engaging protuberance 9 is formed at the bottom of this transverse beam fitting groove 6 so as to project towards the open portion.

Each connection member 2 includes a rectangular parallelopipedonal base 4 having an elongated flat surface as shown in FIGS. 3 and 7. Each panel fitting plate 5 consists of two fitting support panels 5*a*, 5*b* that are disposed along the side edge of the longer side and at its center, respectively, in such a manner as to cross at right angles and to describe a substantially T-shaped form and are parallel to each other. A thinly elongated panel fitting groove 6 is likewise defined between these fitting support plates 5*a*, 5*b* also in the T-shaped form. An engaging protuberance 7 is formed at the bottom of each panel fitting groove 6 so as to project towards the open portion. On the other hand, a thinly elongated, transverse beam fitting groove 8 is disposed on the base 4 along the outer surface of each fitting plate 5, and an engaging protuberance 9 is formed at the bottom of this transverse beam fitting groove 8 so as to face the open portion.

As shown in FIGS. 4 and 10, each connection member 3 includes a rectangular parallelopipedonal base 4 having a regular square flat surface and panel fitting plates 5 are formed so as to project from both surfaces of the base 4 in the vertical direction and to cross each other at the center. Each fitting plate 5 consists of two fitting support plates 5*a*, 5*b* that are arranged in parallel with each other and define a thinly elongated panel fitting groove 6 between them. This panel fitting groove 6 is defined in the criss-cross form, too. An engaging protuberance 7 is defined at the bottom of each panel fitting groove 6 so as to face each open portion. On the other hand, a thinly elongated, transverse beam fitting groove 8 is disposed on the base 4 along the outer surface of each panel fitting plate 5 and an engaging protuberance 9 is formed at the bottom of each transverse fitting groove 8 so as to face the open portion.

The three kinds of connection members 1, 2, 3 have the same projecting height for their panel engaging plates 5 but do not have any directivity in the vertical direction. The base portion, which becomes the upper surface at the time of use, serves as a rack plate support 4*a*. From the appearance of the rack, it is preferred that the projecting height of each engaging plate 5 is substantially equal to the thickness of the rack plate to be placed thereon.

FIG. 5 shows a panel 10 to be used as the side plate and the back plate. Engaging notches 11 are formed in the vertical direction close to both ends on both side edges of the panel 10.

FIG. 6 shows the transverse beam 12, which is disposed horizontally to support the rack in the direction of width and supports the rack plates placed thereon. The transverse beam 12 has an inverted L-shaped cross-section. Its vertical plate 13 is a portion where the beam 12 is fitted to the connection member, and its both end portions are lower than the rest and are equipped with engaging notches 14 to mate with the engaging protuberances 9 of the afore-mentioned connection members. The horizontal plate portion 15 of the beam is cut off at both ends at an angle of 45° and this is a portion where the rack plate 16 is placed.

Each member has the construction described above. The state of assembly will be described in detail. First, the connection members 1 are used for the corner portions. On the bottom surface of the rack, the panel 10 is detachably fitted to the panel fitting plate 5 of the connection member 1 that projects upward. In other words, in the case of the connection member 1 to be disposed at the corners on the bottom surface and at the back of the rack, the panel 10 for the side plate and the panel 10 for the back plate are fitted to the panel fitting grooves 6 of this connection member 1 so that they cross each other at right angles. In the case of the connection members 1 to be disposed at the front corner portions on the bottom surface, only the panels 10 for the side plates are fitted into the fitting grooves 6 of the connection member 1. On the upper surface of the rack, on the other hand, the panel 10 is detachably fitted to the panel fitting plate 5 of the connection member 1 that projects downward. In other words, in the base of the connection members 1 to be disposed at the back corners on the upper surface, the panel 10 for the side plate and the panel 10 for the back plate are fitted into the panel fitting grooves 6 of the connection member 1 so that they cross each other at right angles. In the case of the connection members 1 to be disposed at the front corners of the upper surface, only the panels 10 for the side plates are fitted into the panel fitting grooves 6 of the connection members 1. Furthermore, at the intermediate stage portions of the rack, the panels 10 are detachably fitted into the panel fitting plates 5 of the connection member 1 that project both upward and downward. In other words, in the case of the connection members 1 to be disposed at the back corners of the intermediate stages, the panel 10 for the side plate and the panel 10 for the back plate are fitted into the panel fitting grooves 6 of the connection member 1 from above and below so that these panels 10 cross each other at right angles. In the case of the connection members 1 to be disposed at the front corner portions of the intermediate stages, only the panels 10 for the side plate are fitted into the panel fitting grooves 6 of the connection member 1 from the vertical direction.

The connection member 2 is used at the intermediate portion of the direction of width of the rack. The panels 10 for the back plate are fitted into the panel fitting groove 6 of the connection member 2 from two directions and the panel 10 for the side plate is also fitted to the panel fitting groove 6 in such a manner as to cross the panels 10 for the back plates at right angles. In the case of the connection members 2 to be disposed on the upper and bottom surfaces of the rack, only the panels 10 are fitted to the engaging plates 5 of the connection members 2 that project upward and downward, respectively, in the same way as in the connection members 1.

As described above, the panels 10 are fitted to the connection members 1 or 2 in accordance with the respective positions of the rack. In the panels 10 thus fitted, the engaging notches 11 defined close to their end portions are engaged with and anchored to the engaging protuberances 7 that project from the bottom of the fitting grooves 6. Furthermore, both end portions of each transverse beam 12 are fitted into the transverse beam fitting groove 8 defined on each of the connection members 1 and 2. The transverse beam 12 is disposed horizontally along the side and back plates. The transverse beam 12 disposed at the front of the rack so as to bridge over the side plates are shaped in the from of the horizontal frame for each stage. In this case, the engaging nothces 14 of the transverse beam 12 are engaged with and anchored to the engaging protuberances that project from the bottom of the transverse beam fitting groove 8. The rack plates 16 are placed on the transverse beam 12 that are thus shaped in the form of the horizontal frame. The panel fitting plates 5 do not project from the rack plates 16 but provide good appearance if their projecting height is made substantially equal to the thickness of the rack plate 16.

The connection member 3 is used particularly for the rack having a large depth in which at least two shelves are defined in the direction of depth. Two panels 10 for the side plates as well as two panels 10 for the back plates are fitted into the criss-cross panel fitting grooves 6 so that they cross orthogonally each other.

The present device has the construction as described above. The panels for the side and back plates are fitted into the panel fitting grooves defined by the panel fitting plates of the connection member, the transverse beams are fitted to the transverse beam fitting grooves defined at the base of the connection member and the rack plates are placed on the transverse beams. According to this arrangement, the rack can be assembled extremely easily and within a short period of time without calling for any assembly jigs, in particular. Moreover, the engaging protuberances are formed at the bottom of the panel fitting grooves and at the bottom of the transverse beam fitting plates while the engaging notches are defined on the panels and on the transverse beams at the positions corresponding to the engaging protuberances. Accordingly, the panels and the transverse beams can be reliably engaged by engaging the engaging notches with the engaging protuberances, and they do not cause shake even after use for an extended period or at the time of earthquake.

Moreover, since the present device does not use any nails or screws at all, it can be easily disintegrated. The constituent members of the rack can be used again because they are not damaged. Hence, the present device is especially suitable for display racks whose design must be frequently changed.

What is claimed is:

1. A rack assembly comprised of a plurality of connection members, transverse beams and panels wherein each connection member is comprised of a base having flat opposing surfaces, at least one pair of parallel, spaced apart panel support plates extending perpendicular from one of said flat surfaces to define a panel fitting groove therebetween, an engaging protuberance extending from said base adjacent an edge thereof and being located in said groove between said plates, at least one transverse beam fitting groove formed in said base adjacent one of said plates, an engaging protuberance located at the bottom of said transverse beam fitting groove, each of said panels having a rectilinear configuration with at least one engaging notch formed in an edge thereof in closely spaced relation to a corner thereof for engagement with the protuberance in the panel fitting groove when a corner of said panel is located in said panel fitting groove and said transverse beam having an engaging notch disposed adjacent each end thereof for engagement with said protuberance in said transverse beam fitting groove when an end of said transverse beam is disposed in said transverse beam fitting groove.

2. A rack assembly apparatus as set forth in claim 1 wherein said transverse beam is comprised of two flat elongated portions connected together at right angles with an engaging notch formed in each end of one of said portions so that upon insertion of an end of said portion into said transverse beam fitting groove said notch will engage said protruberance in said transverse beam fitting groove while the other portion of said transverse beam overlies a flat surface of said base.

3. A rack assembly apparatus as set forth in claim 2 further comprising at least one rack plate supported on the portions of said transverse beam which are disposed in overlying relation to a flat surface of said base.

4. A rack assembly apparatus as set forth in claim 1 wherein two pairs of said panel support plates extend perpendicular to each flat surface of said base member orthogonal to each other with a transverse beam fitting groove disposed adjacent each pair of plates for supporting at least two panels perpendicular to each other.

5. A rack assembly apparatus as set forth in claim 1 wherein said connection member is provided with three pairs of panel support plates disposed perpendicular to said flat surfaces of said base orthogonal to each other and a transverse beam groove disposed adjacent each pair of plates to define a T-shaped connection for said panel.

6. A rack assembly apparatus as set forth in claim 1 wherein said connection member is provided with four pairs of panel support plates disposed perpendicular to said flat surfaces of said base member with a transverse beam groove being disposed adjacent each pair of plates to define a cross type connection member adapted to support four panels perpendicular to each other.

* * * * *